US008100602B2

(12) United States Patent
Mathey

(10) Patent No.: US 8,100,602 B2
(45) Date of Patent: Jan. 24, 2012

(54) APPARATUS FOR INSTALLING ELONGATE SEAL STRIPS

(75) Inventor: Jesse S. Mathey, Perrysburg, OH (US)

(73) Assignee: The D. S. Brown Company, North Baltimore, OH (US)

( * ) Notice: Subject to any disclaimer, the term of this patent is extended or adjusted under 35 U.S.C. 154(b) by 384 days.

(21) Appl. No.: 12/474,495

(22) Filed: May 29, 2009

(65) Prior Publication Data

US 2010/0303547 A1 Dec. 2, 2010

(51) Int. Cl.
*E01C 23/02* (2006.01)

(52) U.S. Cl. ..... 404/87; 404/107

(58) Field of Classification Search ..... 404/87, 404/100, 107; 30/379.5
See application file for complete search history.

(56) References Cited

U.S. PATENT DOCUMENTS

| | | | | | |
|---|---|---|---|---|---|
| 3,307,249 | A | | 3/1967 | Hohoff | |
| 3,364,828 | A | | 1/1968 | Shope et al. | |
| 3,532,032 | A | * | 10/1970 | Weber et al. | 404/87 |
| 3,538,820 | A | * | 11/1970 | Tonjes | 404/74 |
| 3,541,660 | A | | 11/1970 | Soto | |
| 3,570,379 | A | * | 3/1971 | Johnson | 404/87 |
| 3,608,445 | A | * | 9/1971 | Sharpe | 404/87 |
| 4,063,839 | A | | 12/1977 | Brown | |
| 4,090,800 | A | | 5/1978 | Koch | |
| 4,127,350 | A | | 11/1978 | Weber | |
| 4,169,305 | A | | 10/1979 | Kruszona | |
| 4,279,425 | A | | 7/1981 | Beacom | |
| 4,388,016 | A | | 6/1983 | Levey | |
| 4,499,925 | A | | 2/1985 | Kaufmann | |
| 4,522,413 | A | | 6/1985 | Nicholas | |
| 4,548,016 | A | * | 10/1985 | Dubich et al. | 52/749.12 |
| 4,738,562 | A | * | 4/1988 | Howsley | 404/87 |
| 4,765,771 | A | * | 8/1988 | Howsley | 404/74 |
| 4,823,452 | A | | 4/1989 | Cloutier | |
| 4,916,878 | A | | 4/1990 | Nicholas | |
| 5,042,211 | A | | 8/1991 | Nestler | |
| 5,088,256 | A | | 2/1992 | Face, Jr. | |
| 5,096,206 | A | | 3/1992 | Andre et al. | |
| 5,129,754 | A | * | 7/1992 | Brower | 404/65 |
| 5,318,379 | A | * | 6/1994 | Ezell et al. | 404/87 |
| 5,449,248 | A | | 9/1995 | Szita et al. | |
| 5,690,447 | A | | 11/1997 | Metzger | |
| 5,711,536 | A | | 1/1998 | Meyers | |
| RE39,091 | E | | 5/2006 | Kuelker | |
| 2005/0253442 | A1 | | 11/2005 | Huse | |
| 2010/0080653 | A1 | * | 4/2010 | Lewis et al. | 404/74 |

* cited by examiner

*Primary Examiner* — Gary S Hartmann
(74) *Attorney, Agent, or Firm* — David D. Murray

(57) ABSTRACT

A machine or apparatus for installing resilient or elastomeric strip seals of indefinite length in expansion joints in, for example, highways and bridges. The machine includes an open, upper frame connected to a lower frame supported at its four corners by four freely rotating wheels. A pair of clamping pistons on the lower frame includes rollers which are adjusted to engage one face of the expansion joint. A toothed wheel or blade rotates about an inclined axis and is powered by a motor through a speed reducing gearbox. The toothed wheel engages the seal and forces it into a channel on the side of the expansion joint opposite to the side engaged by the rollers.

20 Claims, 7 Drawing Sheets

APPARATUS FOR INSTALLING ELONGATE SEAL STRIPS

FIELD

The present disclosure relates to apparatus for and method of installing elongate seals and more particularly to a machine for and method of installing elastomeric strip seals of indefinite length in expansion joints in highways and bridges.

BACKGROUND

The statements in this section merely provide background information related to the present disclosure and may or may not constitute prior art.

In many highway installations and virtually all modern concrete deck bridges, sections of the structure are separated by expansion joints. Such joints run transversely or obliquely to the length and traffic flow of the structure and allow for longitudinal expansion and contraction resulting from ambient temperature changes. Typically, the ends of the concrete section adjacent the expansion joint are trimmed out with a cast in place metal frame or rail member which defines a re-entrant or "C"-shaped slot or channel. Secured within the opposed channels and extending across the expansion joint is an resilient seal strip. The seal strip may define a "V"-shaped or other cross section as installed so that it can accommodate increase or reduction of the width of the expansion joint. The seal strip maintains the water-tightness of the bridge deck thereby preventing foreign material and water from falling and collecting on the superstructure.

As ubiquitous as such expansion joint rails and seals have become, the installation of the two edges of the seal strip into the opposed rail channels is not an easy task. First of all, it is highly labor intensive and essentially takes place at or slightly below surface level. Thus, it is difficult for workers to comfortably and carefully perform the tedious installation process. Unfortunately, even the smallest gaps resulting from incomplete installation can effectively negate the benefits of the strip seal. Second of all, for the same reasons installation is difficult, it is also difficult to carefully and fully inspect the installed seal strip. Finally, although a combination lubricant and adhesive is utilized to facilitate installation of the strip seal, unless the edges of the seal strip are fully seated in the channels, the strip may dislodge, thereby failing to achieve its intended purpose. The foregoing difficulties suggest that an improved manner of installing the strip seal in expansion joint rails would be desirable.

SUMMARY

The present invention provides an apparatus for and method of installing resilient, elastomeric strip seals of indefinite length in expansion joints in, for example, highways and bridge decks. The machine includes an open, upper frame connected to a lower frame supported at its four corners by four freely rotating wheels. A pair of clamping pistons on the lower frame includes rollers which are adjusted to engage one face of the expansion joint. A toothed wheel or blade rotates about an inclined axis and is powered by an air motor through a speed reducing gearbox. The toothed wheel engages the seal and forces it into a channel on the side of the expansion joint opposite to that engaged by the rollers. The machine includes components which facilitate adjustment of both height and angle of incline of the toothed wheel. Pneumatic pressure regulators and valves disposed on the open, upper frame control air flow to the pistons and the air motor.

A pair of smaller, auxiliary wheels, also attached to the upper frame, facilitates transport of the machine in a horizontal position to reduce the possibility of accidental damage to the rollers and toothed wheel.

The installation method comprehends the steps of placing the strip seal adjacent the two parallel rails in the deck, spreading or spraying a lubricant/adhesive in the lower grooves of the rails, installing the lower lug of each edge of the seal in the lower grooves in the rails, spreading or spraying a lubricant/adhesive on the upper lugs at each edge of the seal, disposing a machine having a rotating installation wheel against an upper lug on one edge of the seal and rotating the wheel to continuously install the upper lug in the upper groove of the rail. The machine and wheel are then repositioned and the other, upper lug is installed in the adjacent rail in the same direction by the rotating wheel.

Thus it is an object of the present invention to provide a machine for installing resilient strip seals in expansion joints in, for example, highways and bridges.

It is a further object of the present invention to provide a machine for installing elastomeric strip seals of indefinite length in expansion joints in, for example, highways and bridges.

It is a still further object of the present invention to provide a machine for installing elastomeric strip seals having an open, upper and a lower frame.

It is a still further object of the present invention to provide a machine for installing elastomeric strip seals having a pair of air cylinders and pistons having rollers for engaging a face of an expansion joint.

It is a still further object of the present invention to provide a machine for installing elastomeric strip seals having a seal installing wheel powered by an air motor through a speed reducing gearbox.

It is a still further object of the present invention to provide a machine for installing elastomeric strip seals having an inclined, toothed wheel powered by an air motor through a speed reducing gearbox.

It is a still further object of the present invention to provide a method of installing elastomeric strip seals of indefinite length in expansion joints in, for example, highways and bridges.

It is a still further object of the present invention to provide a method of continuously installing elastomeric strip seals of indefinite length in expansion joints in, for example, highways and bridges.

It is a still further object of the present invention to provide a method of continuously installing elastomeric strip seals of indefinite length with a rotating, toothed wheel.

Further objects, advantages and areas of applicability will become apparent from the description provided herein. It should be understood that the description and any specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
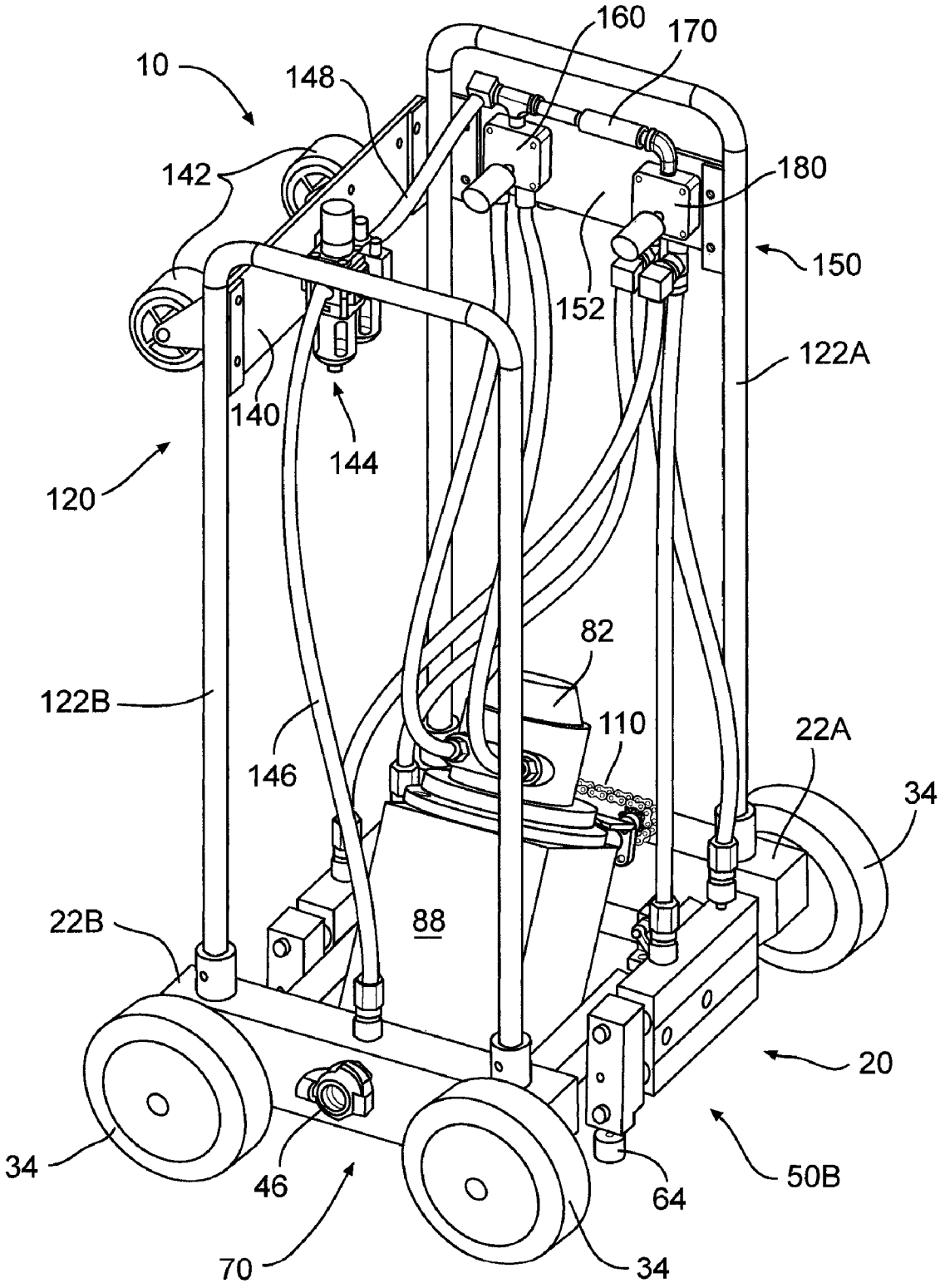
FIG. 1 is a perspective view of a strip seal installing machine according to the present invention.
Figure 2:
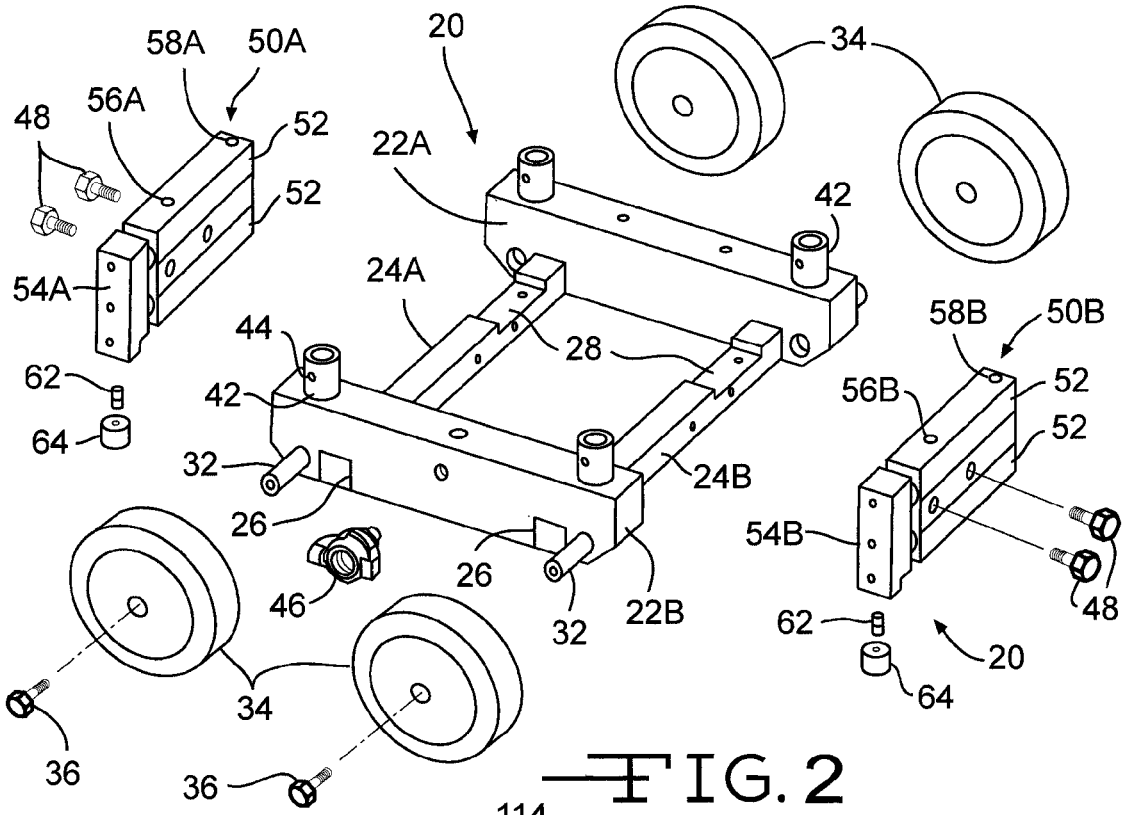
FIG. 2 is an exploded perspective view of a base portion of a strip seal installing machine according to the present invention.
Figure 3:
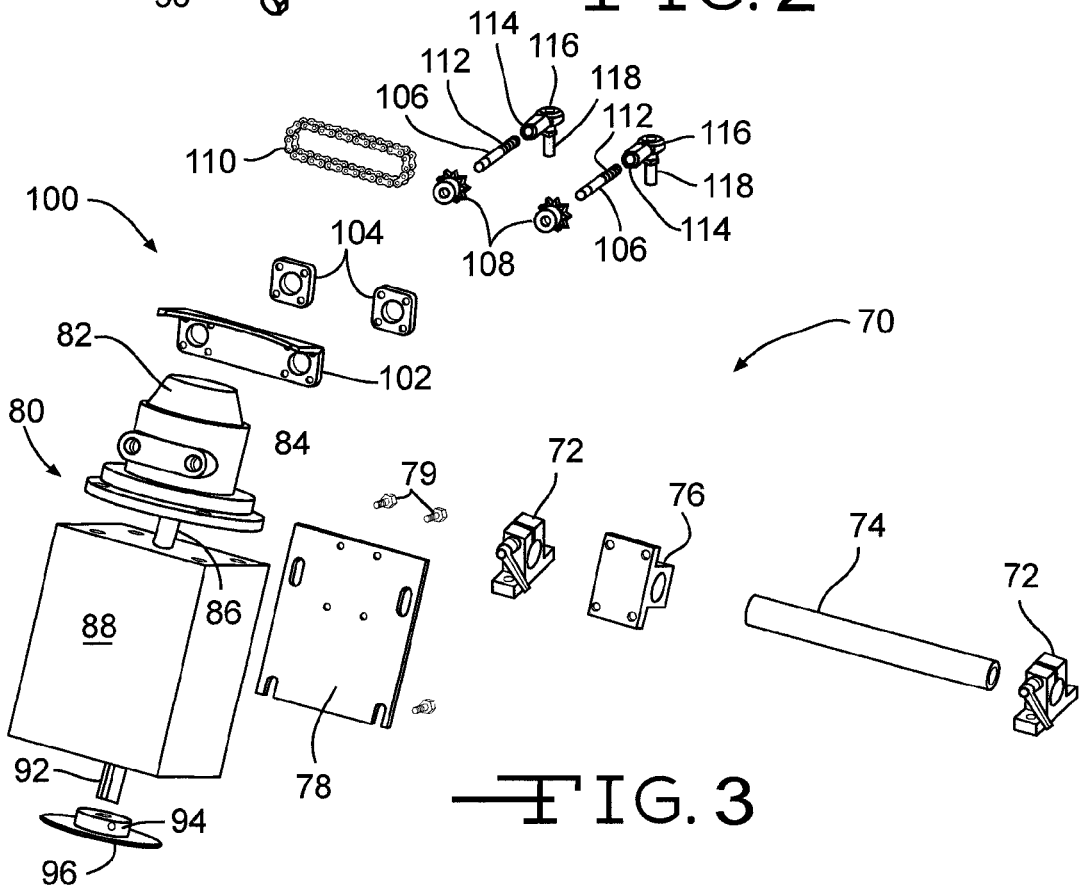
FIG. 3 is an exploded perspective view of a seal insertion assembly of a strip seal installing machine according to the present invention.

With reference to FIG. 1, a strip seal installing machine according to the present invention is illustrated and generally designated by the reference number 10. The strip seal installing machine 10 includes several assemblies which will be described and illustrated separately in the following text and drawings including a lower frame assembly 20 illustrated in FIG. 2, a seal insertion assembly 70 illustrated in FIG. 3, an upper frame assembly and portion of the air circuit 120 illustrated in FIG. 4 and controls and the remaining portion of the air circuit 150 illustrated in FIG. 5.

Referring now to FIGS. 1, 2, 6 and 7, the lower frame assembly 20 includes a pair of parallel, spaced-apart box beams 22A and 22B which are connected by a pair of transverse rails 24A and 24B. Preferably, the box beams 22A and 22B include notches or cut-outs 26 which receive the transverse rails 24A and 24B and are secured to the rails 24A and 24B by welding or other positive means. The transverse rails 24A and 24B also include notches or cutouts 28 located proximate the front box beam 22A. Extending transversely from the outer corners of the box beams 22A and 22B are four shafts or axles 32 which each freely rotatably receive one of four rubber tired wheels 34. The wheels 34 are retained on the axles 32 by four threaded fasteners 36, snap-on retainers or similar removable retention devices. On the top and at each end of the box beams 22A and 22B are secured four circular, blind sockets 42, the purpose of which will be described subsequently. Each of the blind sockets 42 includes a pair of through, aligned openings 44 in the walls of the sockets 42. Finally, on the outer face of the rear box beam 22B is disposed a quick-connect female air supply fitting or connector 46. The air supply connector 46 receives a complementary male connector (not illustrated) which is connected to a hose and a source of pressurized air (also not illustrated).

Secured to the outer faces of each of the pair of transverse rails 24A and 24B by suitable fasteners 48 are a pair of pneumatic cylinder assemblies 50A and 50B. Each of the pneumatic cylinder assemblies 50A and 50B include a pair of vertically stacked, double acting piston and cylinder assemblies 52 which are coupled to and bi-directionally translate a common drive plate 54A and 54B. On each of the upper piston and cylinder assemblies 52 are a pair of air supply ports. Two first ports 56A and 56B communicate with one end of the cylinder assemblies 50A and 50B and, when supplied with air under pressure, the common drive plates 54A and 54B retract. Two second ports 58A and 58B communicate with the other end of the cylinder assemblies 50A and 50B and, when supplied with air under pressure, the common drive plates 54A and 54B extend. A shaft 62 is secured to each of the drive plates 54A and 54B, extends downwardly therefrom and freely rotatably receives a stiffly resilient idler or clamping or locating wheel 64. The locating wheels 64 are preferably fabricated of rubber or a similar elastomer.

Referring now to FIGS. 1, 3, 6 and 7, the seal insertion assembly 70 includes a pair of spaced-apart locking stanchion blocks 72 which are secured within the notches or cutouts 28 of the transverse rails 24A and 24B by suitable fasteners or welding (not illustrated). A stanchion shaft 74 is received, selectively locked within and extends between the stanchion blocks 72. A third stanchion block 76 is received on and tightly secured to the stanchion shaft 74 and is attached to a mounting plate 78 by suitable fasteners (not illustrated). The mounting plate 78 is, in turn, secured to an air motor assembly 80 by a plurality of, preferably four, threaded fasteners 79 extending through elongate slots in the mounting plate 78. The pair of stanchion blocks 72 may be unlocked to allow the stanchion shaft 74, the third stanchion block 76, the mounting plate 78 and the air motor assembly 80 to rotate about the axis of the stanchion shaft 74 to adjust the angle of incline of the air motor assembly 80. The vertical position of the air motor assembly 80 may be adjusted by loosening the threaded fasteners 79, moving the air motor assembly 80 up or down as necessary relative to the mounting plate 78 and re-tightening the fasteners 79.

The air motor assembly 80 includes an air motor 82 having air supply and exhaust ports 84 and an output shaft 86 that directly drives a gear or speed reduction unit 88. The air motor 82 provides a nominal output speed of 700 to 800 r.p.m. at load. The gear reduction unit 88 preferably provides a speed reduction of approximately 14 to 16 to 1. The gear reduction unit 88 includes an output shaft 92 which is coupled to and directly drives a toothed insertion wheel or blade 94. The output shaft 92 of the gear reduction unit 88 rotates at between 45 and 55 r.p.m. The insertion wheel 94 is between four and eight inches in diameter and is preferably about six inches in diameter and includes a plurality of teeth 96, between sixty-five and seventy-five teeth 96 and preferably about seventy-two teeth 96, about its periphery An inclination adjustment assembly 100 cooperates with the pair of locking stanchions 72 and the stanchion shaft 74 to adjust and fix the angle of inclination of the air motor assembly 80 and thus of the insertion wheel 94 relative to the lower frame assembly 20 and the adjacent, supporting surface. The adjustment assembly 100 includes an angle bracket 102 which is secured to the air motor assembly 80 by suitable fasteners (not illustrated) and carries and supports a pair of bearings 104. The pair of bearings 104 each freely rotatably receives and supports a pair of stub shafts 106. Each of the stub shafts 106 is secured to and rotates an associated chain sprocket 108. The pair of chain sprockets 108 are coupled for simultaneous rotation by a chain 110. Each of the stub shafts 106 includes male threads 112 at its end opposite the chain sprocket 106. The threaded end of each stub shaft 106 is received within female threaded openings 114 in a right angle spherical bushing or bearing 116. Each of the spherical bearings 116 includes a pin or locating stub 118 oriented generally at a right angle to the axis of the threaded opening 114 which is received within an aperture or blind hole in the front box beam 22A. As the chain 110 is moved, the threaded stub shafts 106 rotate in unison, effectively increasing or decreasing the distance between the angle bracket 102 (and the air motor 82) and the front box beam 22A, thereby adjusting the angle of incline of the air motor assembly 80 and the toothed wheel 94. The air motor assembly 80 is maintained in its desired center position on the stanchion shaft 74 by the inclination adjustment assembly 100.

It should be understood that other, simpler inclination adjustment assemblies are deemed to be within the scope of this invention. For example, a single assembly such as a turnbuckle (not illustrated) or a single bearing 104, single stub shaft 106 and single spherical bearing 116, and many other linear adjustment mechanisms may be utilized. However, since the air motor assembly 80 provides the sole driving force to the strip seal installing machine 10 and thus generates reaction torque, it has been determined that a pair of co-acting, spaced-apart devices which stabilize the air motor assembly 80 is a preferred configuration.

Figure 4:
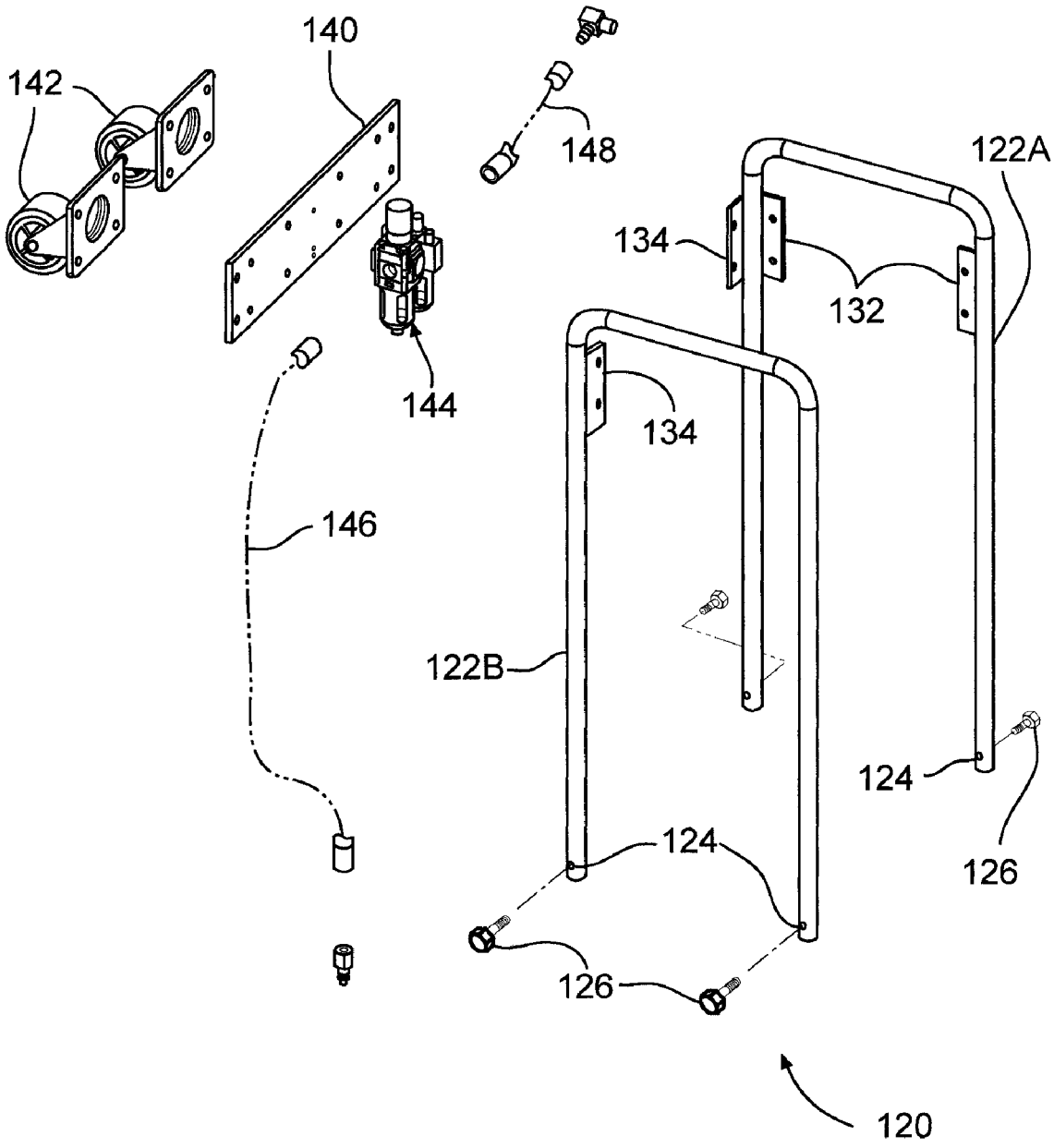
FIG. 4 is an exploded perspective view of an upper frame assembly of a strip seal installing machine according to the present invention.

Referring now to FIGS. 1 and 4, the upper frame assembly and portion of the air circuit 120 includes a pair of spaced-apart, inverted U-shaped frames 122A and 122B. The front upper frame 122A is received within the sockets 42 on the front box beam 22A and the rear upper frame 122B is received within the sockets 42 on the rear box beam 22B. The lower ends of the frames 122A and 122B include radially aligned openings 124 that align with the openings 44 in the sockets 42 and receive retaining pins 126 which, in turn may be retained in the sockets 42 by clips or cotter pins (both not illustrated). The upper frames 122A and 122B may be single pieces of formed tubing or multiple sections connected by corner components. The front upper frame 122A includes a pair of front panel mounting brackets 132. A second pair of side mounting brackets 134 are secured to each of the upper frames 122A and 122B and receive a side mounting plate 140. The side mounting plate 140 extends between the front upper frame 122A and the rear upper frame 122B and is secured to the side mounting brackets 134 by suitable fasteners or welds (not illustrated). On the outside face of the side mounting plate 140 are disposed a pair of swivel casters 142 which may be secured to the side mounting plate 140 by suitable fasteners or welding (not illustrated).

It should be appreciated that components of the strip seal installing machine 10 such as the clamping or locating wheels 64 and the toothed insertion wheel or blade 94 normally extend below the surface upon which the seal installing machine 10 is disposed. It should also be appreciated that the wheels 34 extend beyond the ends of the box beams 22A and 22B. Accordingly, in order to ensure safe transport of the machine 10 from worksite to worksite, it may readily be tipped on its side, so that it rests on the pair of wheels 34 adjacent the transverse rail 24A and the pair of swivel casters 142. In this orientation, the strip seal installing machine 10 may readily and safely be moved from worksite to worksite or to various locations at one worksite.

On the inside face of the side mounting plate 140 is disposed a pneumatic filtration, lubrication and air pressure regulation assembly 144. The filtration, lubrication and air pressure regulation assembly 144 is a conventional assembly that filters the air supplied to the strip seal installing machine 10, regulates the air pressure delivered to the components of the machine 10 and provides a metered quantity of lubricant in the air delivered to the components of the machine 10 which is especially important to ensure the long service life of the air motor 82. The pneumatic assembly 144 is supplied with pressurized air through an inlet hose or line 146 which communicates with the inlet fitting or connector 46. An outlet hose or line 148 provides filtered, pressure regulated and lubricant containing air to control components of the machine described directly below.

Figure 5:
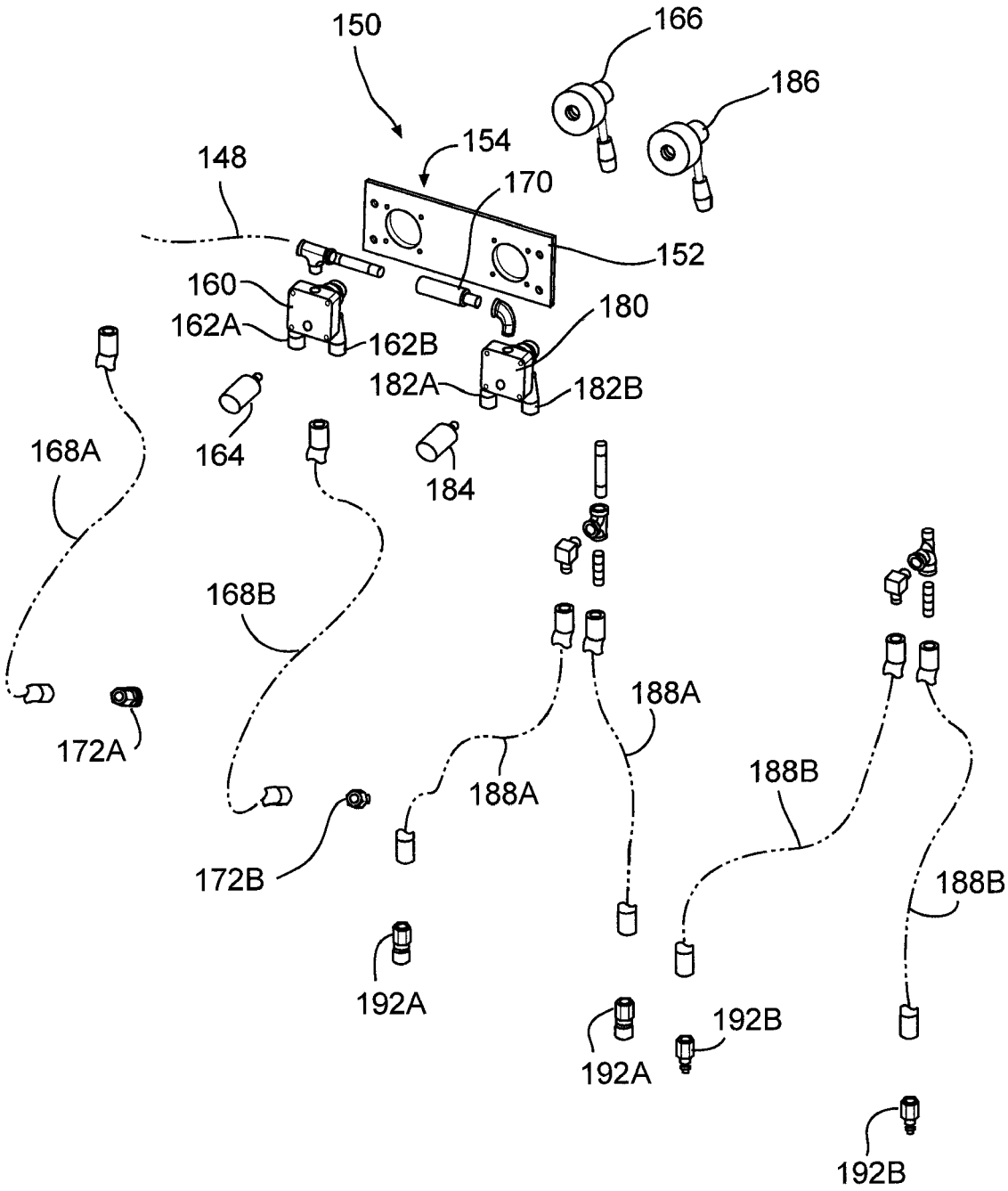
FIG. 5 is an exploded perspective view of an air circuit portion of a strip seal installing machine according to the present invention.
Figure 6:
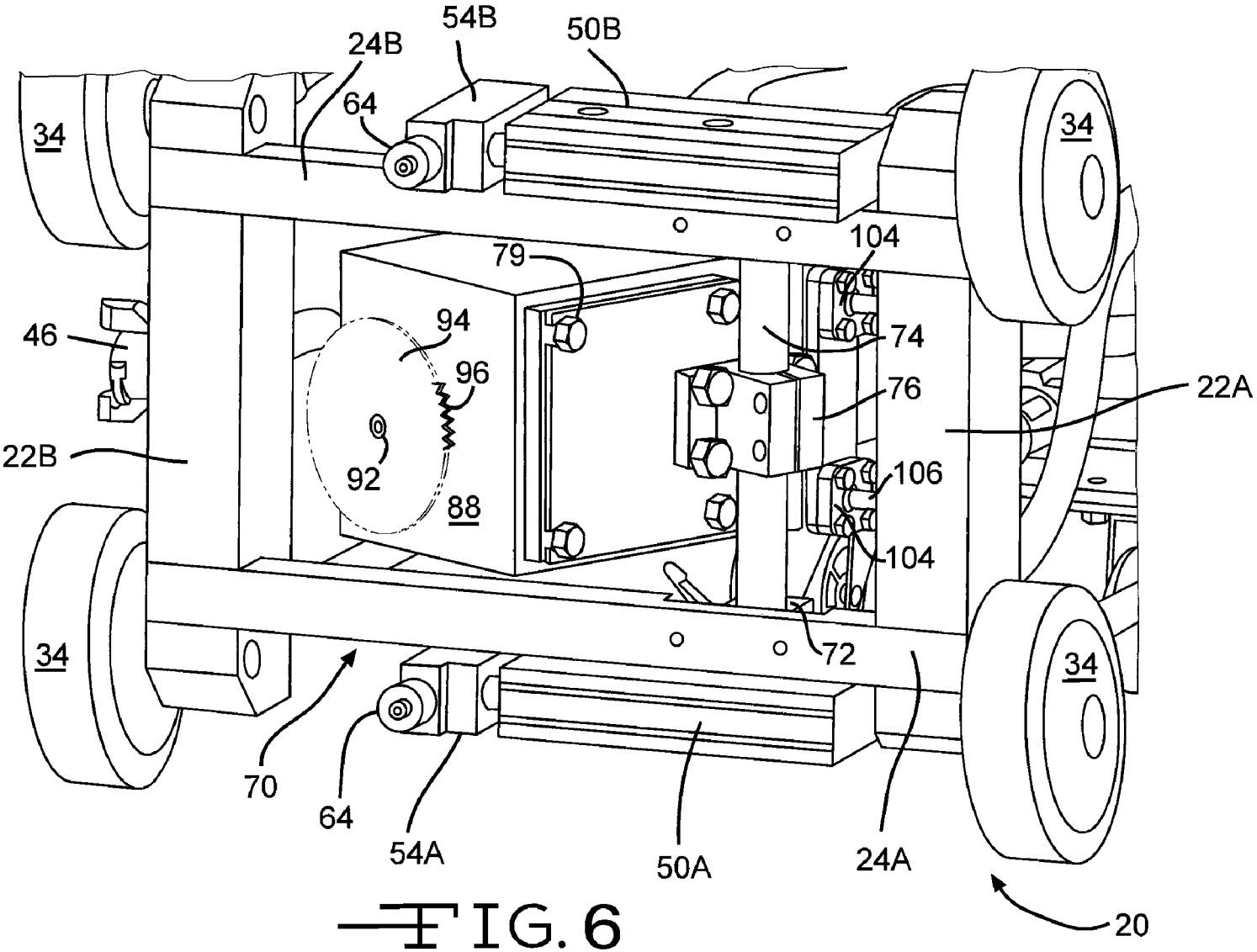
FIG. 6 is a perspective view of the bottom of a strip seal installing machine according to the present invention showing the height adjustment mechanism for the toothed wheel.
Figure 7:
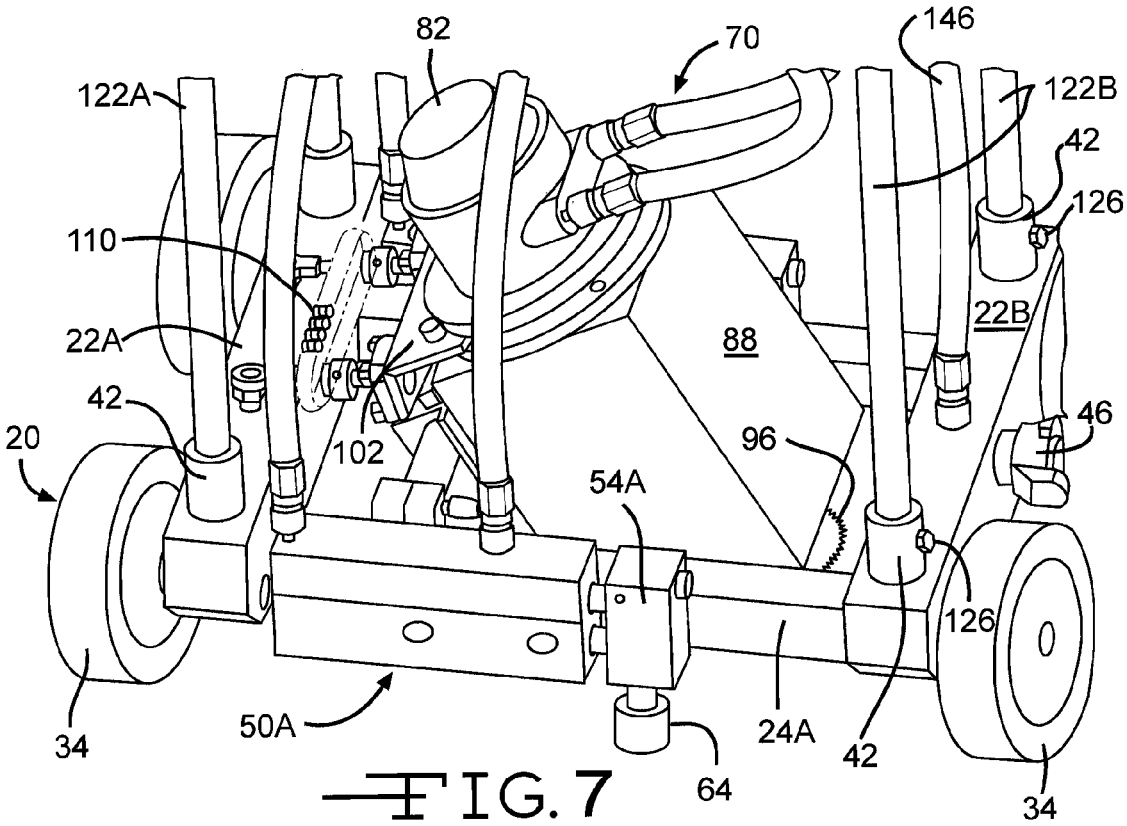
FIG. 7 is a perspective view of the incline adjustment mechanism for the toothed wheel of a strip seal installing machine according to the present invention.

Referring now to FIGS. 1 and 5, the controls and the remaining portion of the air circuit 150 include a front panel 152. The front panel 152 extends between the two uprights of the front upper frame 122A and is secured to the front panel mounting brackets 132 by suitable fasteners or welds (not illustrated). The outlet hose or line 148 is coupled to and communicates with an inlet of a first, air motor control valve 160. The air motor control valve 150 is a bi-directional or reversing valve having two outlets or ports 162A and 162B and which is therefore capable of providing pressurized air to one of the two outlets 162A and 162B while the other outlet 162B or 162A functions as an air return or exhaust path and vice versa. Preferably, an exhaust muffler 164 is connected to the air motor control valve 160 and muffles the sound of the air exhausted by the control valve 160 to the atmosphere.

The air motor control valve 160 thus includes a three position control lever 166 having a center, neutral or off position wherein no air is supplied to the air motor 82, a first, rotated or offset position in which pressurized air is provided through the outlet 162A and returned and exhausted through the outlet 162B and the muffler 164 causing the air motor 82 to rotate in a first direction and a second, oppositely rotated or offset position in which pressurized air is provided through the outlet 162B and returned and exhausted through the outlet 162A and the muffler 164 causing the air motor 82 to rotate in a second, opposite direction. A first air motor supply hose or line 168A communicates between the outlet or port 162A and one inlet or port 172A of the air motor 82 and a second air motor supply hose or line 168B communicates between the outlet or port 162B and one inlet or port 172B of the air motor 82.

The outlet hose or line 148 also communicates with the input of a secondary or clamp air pressure regulator 178. The secondary air pressure regulator 178 is in series with and downstream of the air pressure regulation assembly 144 and thus it can further reduce the air pressure at its outlet but can provide no higher pressure than that delivered by the air pressure regulation assembly 144. The outlet of the secondary air pressure regulator 178 communicates with an inlet of a second, clamp control valve 180. The clamp control valve 180 is also a bi-directional or reversing valve having two outlets or ports 182A and 182B and which is capable of proving pressurized air to one of the two outlets 182A and 182B while the other outlet 182B or 182A functions as a return or exhaust port and vice versa. Preferably, a second exhaust muffler 184 is connected to the second, clamp control valve 180 and muffles the sound of the air exhausted by the clamp control valve 180 to the atmosphere.

The second, clamp control valve 180 also includes a three position control lever 186 having a center, neutral or off position wherein no air is supplied to the pneumatic cylinder assemblies 50A and 50B, a first, rotated or offset position in which pressurized air is provided through the outlet 182A and returned and exhausted through the outlet 182B and the muffler 184 causing the pneumatic cylinder assemblies 50A and 50B to translate in a first direction and a second oppositely rotated or offset position in which pressurized air is provided through the outlet 182B and returned and exhausted through the outlet 182A and the muffler 184 causing the pneumatic cylinder assemblies 50A and 50B to translate in the opposite direction. A first pair of pneumatic cylinder supply hoses or lines 188A communicate between the outlet or port 182A and a pair of inlets or ports 192A of the piston and cylinder assemblies 50A and 50B and a second pair of pneumatic cylinder supply hoses or lines 188B communicate between the outlet or port 182B and a pair of inlets or ports 192B of the piston and cylinder assemblies 50A and 50B.

It will thus be appreciated, first of all, that adjustment of the secondary or clamp air pressure regulator 178 will control the force generated by the piston and cylinder assemblies 50A and 50B and applied by the clamping or locating wheels 64 and, second of all, that air pressure in the lines or hoses 188A will advance (release) the pistons and clamping wheels 64 and air pressure in the lines or hoses 188B will retract (engage) the pistons and clamping wheels 64.

Figure 9:
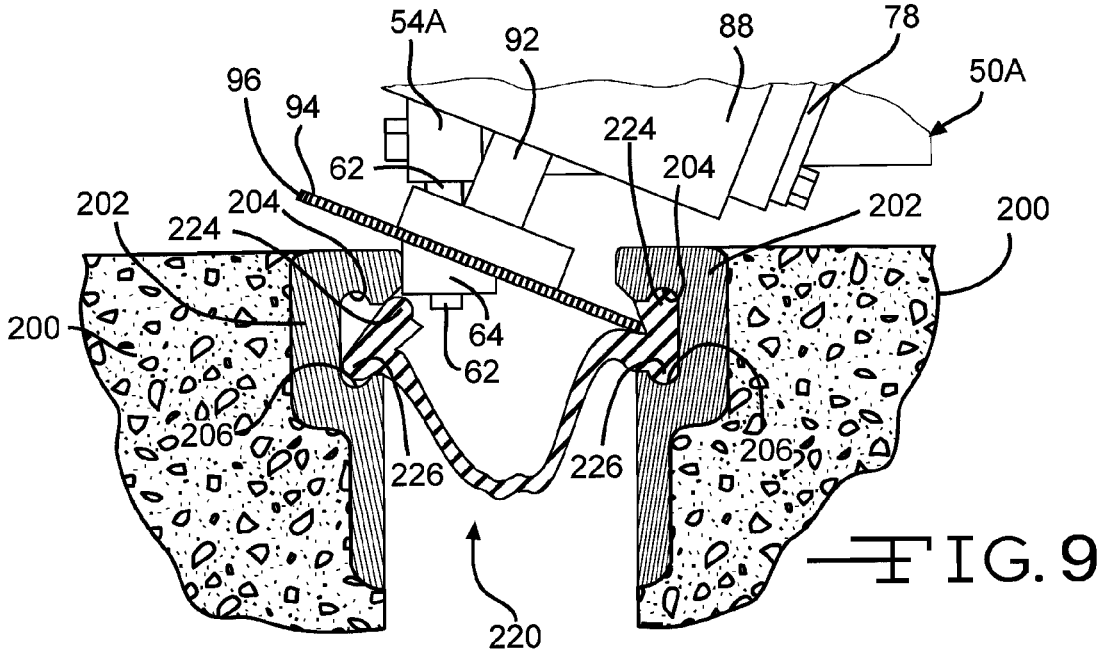
FIG. 9 is an enlarged, side elevational view of the process of installation of an expansion joint strip seal in an expansion joint with the strip seal installing machine according to the present invention.

Referring now to FIGS. 1, 6, 7, 8 and 9, a description of set-up, adjustment and operation of the strip seal installing machine 10 will be presented. It will be appreciated that in order to locate the toothed insertion wheel or blade 94 at its optimum position as illustrated in FIG. 9 of between 25° and 30° and preferably 28° to the bridge deck 200 or other horizontal surface and with the lower edge of the toothed blade 94 just below the upper edge of the upper channel 204 in a rail 202, it may be necessary to raise or lower the air motor assembly 80 or adjust its angle of incline. To adjust the height of the air motor assembly 80 and the wheel or blade 94, the threaded fasteners 79 are loosened, the air motor assembly 80 is moved up or down as necessary relative to the mounting plate 78 and the fasteners 79 are re-tightened. To adjust the angle of incline, either to the preferred angle of 28°, to accommodate the spacing of the rails 202 or for other reasons, the locking stanchion blocks 72 are unlocked and the chain 110 is translated clockwise or counter-clockwise to adjust the angle of incline of the air motor assembly 80. Upon achieving a desired or satisfactory angle of the wheel or blade 94, the stanchion blocks 72 are re-locked.

Figure 8:
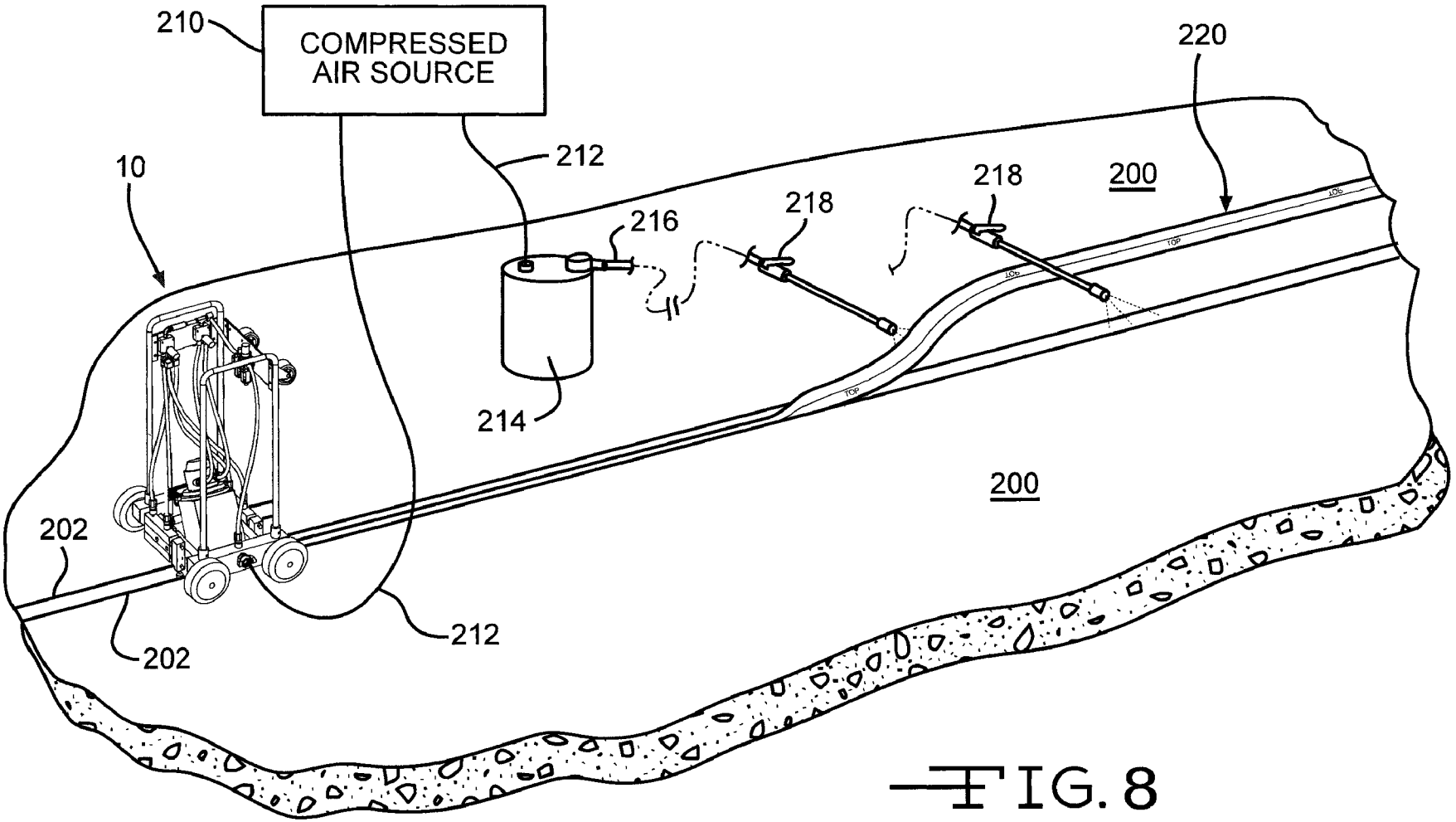
FIG. 8 is a perspective view of an exemplary flat surface such as a bridge deck and the equipment and steps relating to installation of a strip seal according to the present invention.

As illustrated particularly in FIG. 8, to install a resilient or elastomeric strip seal 220, the strip seal 220 is placed into position generally parallel to and proximate the rails 202. A source of compressed air 210, such as a gas powered air compressor, provides compressed air in a line 212 to the strip seal installing machine 10 and, if desired, to a lubricant/adhesive container 214. A suitable lubricant-adhesive compound from the container 214 is supplied through a hose 216 to one or more application wands 218. Alternatively, the lubricant/adhesive may be applied with rollers or brushes. First, the lubricant/adhesive is liberally applied or sprayed on the sides and the lower grooves or channels 206 of each rail 202. Then, the strip seal 220 is placed between the rails 202 and the lower lugs 226 are positioned in the lower grooves or channels 206. Next, the lubricant/adhesive is applied liberally to the upper lugs 224 of the strip seal 220 and the wheel or blade 94 of the strip seal installing machine 10 is disposed as illustrated in FIG. 8.

The second, clamp control valve 180 is rotated so that the clamping piston and cylinder assemblies 50A and 50B extend, moving the wheel or blade 94 into the position and maintaining it in the position illustrated in FIG. 9. The first, air motor control valve 160 is then positioned so that the air motor 82 begins to rotate the wheel or blade 94, translating the strip seal installing machine 10 slowly and continuously along the rails 202, to the right in FIG. 8, and installing the strip seal 220 in the upper groove or channel 204. Typical installation speed of the strip seal 220 will be approximately 25 feet per minute or less. The strip seal 220 is installed in the opposing upper channel 204 of the opposing rail 202 by the same method and preferably in the same direction.

It will be appreciated that on many bridge decks and similar transversely confined roads such as within tunnels, guardrails and similar structures along traffic lanes will obstruct the path of the strip seal installing machine 10 and prevent it from installing the ends of the strip seal 220. In such situations, labor intensive, prior art installation techniques may be utilized to install end and obstruction adjacent portions of the strip seal 220.

The description of the invention is merely exemplary in nature and variations that do not depart from the gist of the invention are intended to be within the scope of the invention. Such variations are not to be regarded as a departure from the spirit and scope of the invention and the following claims.

What is claimed is:

1. An apparatus for installing a strip seal in an expansion joint, comprising, in combination, a frame supported for movement on a plurality of wheels, a pair of spaced-apart linear actuators secured to said frame for bi-directionally translating a respective pair of rollers, a drive motor and speed reducing assembly having an output and a circular blade driven by said output, means for adjusting an angle and position of said circular blade relative to said frame, and means for controlling operation of said linear actuators and said drive motor.

2. The apparatus of claim 1 wherein said drive motor is an air motor.

3. The apparatus of claim 1 wherein said means for adjusting an angle includes means for adjusting a distance between said drive motor and said frame.

4. The apparatus for claim 3 wherein said means for adjusting a distance includes a pair of threaded shafts received in swivel bearings mounted on said frame and a respective pair of chain sprockets secured to said shafts and having a chain extending between said sprockets.

5. The apparatus of claim 1 wherein said means for adjusting a position includes a plate secured to said speed reducing assembly and a plurality of fasteners for securing said plate to said speed reducing assembly.

6. The apparatus of claim 1 wherein said rollers are on opposite sides of said circular blade.

7. The apparatus of claim 1 further including an air inlet fitting, a filtration, regulation and lubrication assembly and air lines communicating between said inlet fitting and said filtration assembly, said filtration assembly and said controlling means and said controlling means and said linear actuators and said drive motor.

8. An apparatus for installing an elongate seal in an expansion joint, comprising, in combination, a frame supported on a plurality of wheels, a pair of spaced-apart linear actuators secured to said frame for bi-directionally translating a respective pair of rollers, a drive motor coupled to and driving a speed reducing assembly having an output and an installation wheel driven by said output, means for adjusting an angle and position of said installation wheel relative to said frame, a first control for controlling operation of said drive motor, and a second control for controlling operation of said linear actuators.

9. The apparatus of claim 8 further including an upper frame assembly removably attached to said frame, said first control and said second control supported by said upper frame assembly.

10. The apparatus of claim 8 further including an upper frame assembly extending from said frame and a pair of casters supported by said upper frame assembly.

11. The apparatus of claim 8 wherein said controls are valves and further including an exhaust muffler disposed on each of said controls.

12. The apparatus of claim 8 wherein said second control is a valve and further including a pressure regulator for regulating air pressure delivered to said second control.

13. The apparatus of claim 8 wherein said frame includes a plurality of sockets and further including an upper frame including a pair of U-shaped members having ends disposed in said sockets.

14. The apparatus of claim 8 wherein said controls are valves and each valve includes two outlet ports and provides pressurized air to one of said outlet ports and receives exhaust air in another of said outlet ports in a first control position and provides pressurized air to said another of said outlet ports and receives exhaust air in said one of said outlet ports in a second control position.

15. An apparatus for installing an elongate seal in an expansion joint of a bridge or pavement, comprising, in combination, a frame supported for translation on a plurality of wheels along a first axis, a pair of spaced-apart linear actuators secured to said frame for bi-directionally translating a respective pair of clamping rollers along parallel second axes perpendicular to said first axis, an air motor having an output, a speed reducing assembly having an input coupled to said air motor output and an output and a toothed wheel coupled to said output, means for adjusting an angle and position of said toothed wheel relative to said frame, a first control valve for controlling operation of said air motor, and a second control valve for controlling operation of said linear actuators.

16. The apparatus of claim 15 wherein said toothed wheel is disposed between said clamping rollers.

17. The apparatus of claim 15 wherein said first control valve provides bi-directional rotation of said air motor.

18. The apparatus of claim 15 wherein said angle adjusting means includes a pair of threaded rods each received in a threaded bushing and means for rotationally coupling said rods.

19. The apparatus of claim 15 wherein said frame includes a plurality of sockets and further including an upper frame assembly having a pair of U-shaped members having ends disposed in said sockets and a plate extending between said members and wherein said first control valve and said second control valve are mounted on said plate.

20. The apparatus of claim 15 wherein said position adjusting means includes a plate secured to said speed reducing assembly by a plurality of removable fasteners.

* * * * *